United States Patent [19]

Oliver

[11] 4,143,817

[45] Mar. 13, 1979

[54] AUTOMATIC FIREPLACE HEATING SYSTEM

[76] Inventor: John F. Oliver, 112 W. 31st St., Wilmington, Del. 19802

[21] Appl. No.: 769,726

[22] Filed: Feb. 17, 1977

[51] Int. Cl.[2] ..... F24B 7/00

[52] U.S. Cl. ..... 237/51; 237/55; 165/DIG. 2; 122/20 B; 126/121

[58] Field of Search ..... 237/55, 51, 12.3 B; 165/DIG. 2, 35; 122/20 B; 126/121

[56] References Cited

U.S. PATENT DOCUMENTS

| | | | |
|---|---|---|---|
| 1,245,488 | 11/1917 | Millis | 122/20 B |
| 1,633,759 | 6/1927 | Breese | 165/35 |
| 1,746,564 | 2/1930 | Summers | 165/35 |
| 1,885,267 | 11/1932 | Kalfus | 122/20B |
| 2,103,947 | 12/1937 | Holmes | 165/35 |
| 2,650,576 | 9/1953 | Tidd | 237/19 |
| 3,131,757 | 5/1964 | Bergstrom et al. | 165/35 |
| 3,650,318 | 3/1972 | Avery | 165/35 |
| 3,999,709 | 12/1976 | Estabrook | 165/DIG. 2 |
| 4,025,043 | 5/1977 | Cleer, Jr. | 126/121 |
| 4,040,477 | 8/1977 | Garberick | 165/DIG. 2 |
| 4,050,627 | 9/1977 | Mayer | 165/DIG. 2 |

*Primary Examiner*—Henry C. Yuen
*Attorney, Agent, or Firm*—Plumley and Tyner

[57] ABSTRACT

An automatically controlled residential heating system based on the heat from a fireplace comprising the normal fireplace, hearth, combustion zone, flue, and damper; the flue being divided into two parallel flue passages one of which is unobstructed and the other of which contains a heat exchanger adapted to absorb the heat from the flue gases into a fluid passing through the heat exchanger and then into space heating elements in the residence; the system including automatic devices for sensing the temperature in the heat exchanger and the temperature in the residential spaces to be heated, an automatic control to act upon the temperature sensing means and to move a diverter which serves to pass the flue gases into either or both of the parallel flue passages in any desired proportion, an automatic relief valve means for relieving excessive temperature build-up in the heat exchanger, and an automatic extinguishing device for extinguishing the burning material in the fireplace if the means for sensing the temperature in the heat exchanger reaches an undesirably high level.

3 Claims, 3 Drawing Figures

AUTOMATIC FIREPLACE HEATING SYSTEM

This invention relates to a residential heating device based on the heat from a fireplace, and more particularly it relates to a fully automatically controlled system for utilizing the heat in the flue gases of the fireplace system to heat a fluid which can be circulated to space heaters at any desired location in the residence.

Fireplaces are well known features of many residences. In some instances these fireplaces are the main sources of heat for the room in which the fireplace is located while in other instances they serve principally as a decorative feature supplying the pleasing effect of burning logs while actually making very little use of the heat generated in the fireplace. In some instances the fireplaces are adapted for burning logs or coal while in other instances they are fitted with gas-or oil-fired burners and do not reply upon the combustion of solid fuels for the generation of heat. Regardless of the features of the system employed it is universally true that only a very small portion of the heat generated in the fireplace is used to heat the building in which the fireplace is located. The major portion of the heat produced by the fireplace is transmitted through the room in which the fireplace is located in the form of radiation energy from the flame of the burning fuel and the combustion gases which rise through the flue are expelled outward through a chimney with the heat in those gases being substantially completely unused in heating the residence. There is, of course, a certain amount of heating of the walls of the flue which in turn provide heat for the areas of the residence near those walls but this is a relatively minor effect.

Many attempts have been made in the past to recover some portion of the heat in the combustion gases from a fireplace. These frequently take the form of pipes filled with water passing through the upper portions of the fireplace combustion zone or in the form of a "water back" wherein one or more of the walls of the combustion zone comprise hollow spaces filled with water which absorb heat from the combustion zone. Some attempts have been made to circulate the hot water produced in such pipes or "water backs" but none has been integrated into a controlled system which is automatically controlled in accordance with the demands of various locations in the residence and which is protected by various safety features.

It is an object of this invention to provide a residential heating system based on the heat derived from a fireplace. It is another object of this invention to provide an automatically controlled heating system for utilizing the waste heat and flue gases to supplement the heating system in a residence. It is still another object of this invention to provide a fully automatically controlled system for absorbing the heat from flue gases and releasing that heat in distant locations by means of a hot water circulating system. It is still another object of this invention to provide a fully automatically controlled heating system for absorbing the heat in flue gases and releasing that heat in distant locations to supplement a hot air heating system. It is yet another object of this invention to provide a fully automatically controlled residential heating system based upon the heat derived from flue gases, the system being protected from overheating by safety devices. Still other objects will appear from the more detailed description of this invention which follows.

The object of this invention are accomplished by providing a residential heating system based on the heat from a fireplace comprising a fireplace, hearth, combustion zone, flue, and damper for opening and closing the passageway from the combustion zone to the flue, said flue being divided into two full-sized, parallel, independent flue passages, one of which is filled with a heat exchanger adapted to absorb the heat from hot gases passing through the flue into a fluid in said heat exchanger. A movable diverter adapted to direct the hot gases into either parallel flue or into both in any desired proportion, a means for circulating a heat absorbing fluid through said heat exchanger and releasing the absorbed heat through space heaters at other locations, means for sensing the heat in the space to be heated by space heaters, means for sensing the temperature of the fluid in said heat exchanger, means for automatically positioning said diverter to by-pass none, all or any part of said hot gases from said heat exchanger in response to the temperatures of the two said sensing means, means to relieve any undue build-up of heat in said heat exchanger, and means to automatically extinguish the burning material in said combustion zone if the means for sensing the temperature in said heat exchange fluid indicate an undesirably high temperature.

In the attached drawings.

Figure 1:
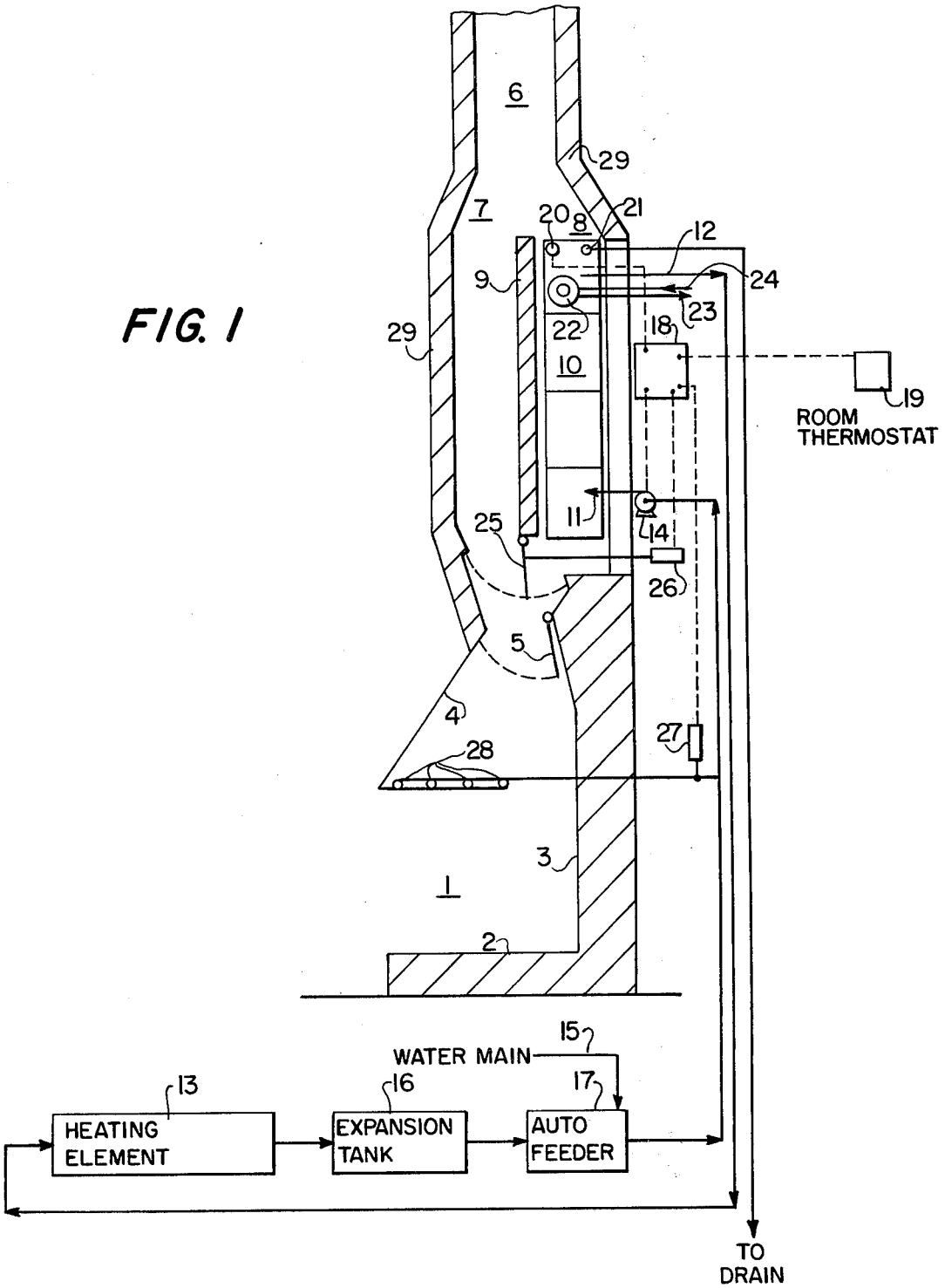
FIG. 1 is a cross-sectional side elevation view of this invention wherein the flue passages are back-to-back.

The more detailed features of this invention can be understood by the reference to the attached drawings of a vertical cross-sectional view of a fireplace and flue with schematic illustrations of how the features of the system for absorbing heat in the flue are connected to other devices and means for utilizing that heat in an automatic system. With specific reference to FIG. 1, the fireplace comprises a combustion zone (1) formed by a hearth (2) and fire walls (3). In the upper portion of combustion zone (1) damper (5) is located in the throat of the flue and is adapted to close combustion zone (1) from the upper portions of the flue. In the embodiments shown in this drawing there is a hood (4) which is designed to catch smoke and fumes rising from the burning materials on hearth (2), although it is to be understood that there are many designs of suitable fireplaces which do not require a hood for such purposes and it is therefore unnecessary for the purposes of this invention to include hood (4) in all embodiments of this invention. Above damper (5) there is a flue passage which is divided into two normal-sized flues in accordance with the requirements of combustion zone (1). These two flue passageways are parallel and independent of one another, being separated by divider wall (9). First flue passage (7) is unobstructed and of a proportion and design which would normally be employed for the size required by combustion zone (1). Second flue passage (8) is filled with heat exchanger (10) which is designed with vertical passageways for flue gases to rise therethrough and is of such a size in combination with the cross-sectional area of second flue passage (8) to permit the free flow of flue gases upwardly. Above the upper portions of flue passages (7) and (8) the cross-sectional area is reduced to the normal size to form smoke pipe (6) for conducting the smoke and gases upwardly to be discharged into the atmosphere. The outer extremities of flue passages (7) and (8) as well as smoke pipe (6) are defined by flue walls (29) which are normally made of refractory brick and are insulated to contain heat inside the passage. At the lower end of the divider wall (9) there is located diverter (25) which is adapted to divert the flue gases rising from combustion zone (1) into either or both of flue passages (7) and (8). The diverter may assume other forms or be fashioned in other designs so long as it is capable of closing one flue passage and opening the other.

The system which absorbs the heat from the rising hot flue gases generated in combustion zone (1) is located in second flue passage (8) and comprises heat exchanger (10). This heat exchanger may be of any appropriate design and made of any suitable material which will permit the upward flow of flue gases around the outside of heat exchanger (10) and the interior flow of fluid, e.g. water, to absorb as much as possible of the heat from those flue gases. Because of the corrosion problems inherent in such a system, it is preferred that the heat exchanger be made of cast iron. It is, of course, to be understood that any other suitable material may be employed, such as stainless steel, aluminum, titanium, copper, or any of a wide variety of alloys which are suitably resistant to high temperatures and to corrosion under the conditions found in a residential flue. In the embodiment shown in this drawing the heat exchanger is made up of several independent sections which are joined together to provide any desirable heat exchange capacity. The particular design of the outer features of heat exchanger (10) are unimportant except that they should be available for cleaning purposes so as to maintain a high level of heat exchange efficiency and the contour must be so constructed as to make available the maximum surface for absorbing heat from the flue gases passing by. There are many designs which are suitable for such a purpose including fins, tortuous passageways, reverse pipe bends, etc.

Heat exchanger fluid which is cold enters heat exchanger (10) at inlet (11) and after circulating through the interior passageways of heat exchanger (10) leaves with the maximum absorption of heat at exit (12). This hot fluid is then available to discharge its absorbed heat at any suitable location which is indicated schematically in this drawing as heating element (13), which is frequently termed a "space heater" to define a hot water radiator, a hot air register, or other conventional means for heating the air in a room. The fluid leaving heating element (13) passages through expansion tank (16) and automatic feeder (17) and thence to the feed of circulator (14) which provides the force to circulate the heat exchange fluid around that system. Expansion tank (16) serves its normal purpose of providing a volume for expansion of the heat exchange fluid to whatever volume is necessary as dictated by the temperature of that fluid. Automatic feeder (17) serves the purpose of maintaining sufficient fluid in this line to serve as the heat exchange medium and automatically makes up any losses or leakage which may have occurred. This may in the instance of a hot water system draw makeup fluid from water main (15). Included within the heat exchanger (10) is an optional means for heating water for domestic use within the residence, such as for washing, cooking, etc. The means shown in this drawing is hot water core (22) joined to inlet line (24) and outlet line (23).

The electric control system which operates the heating system of this invention is centered about a triple acting control switch (18) to which is connected temperature sensing means (20) which may be a bulb-type adjustable temperature senser. This sensing means is adjustable to any desired temperature and is set to a maximum temperature desired in the outlet of the heat exchanger (10). The other temperature sensing means is a room thermostat (19) which functions to demand heat at an external room location where heating element (13) may be located. Control switch (18) in response to the demands of sensing means (20) and thermostat (19) has three operating controls. One is to actuate circulator (14) when thermostat (19) demands more heat. A second control is to move diverter (25) by means of solenoid (26). Solenoid (26) is adapted to move to any location so as to position diverter (25) in any opening or closing from one extremity to the other. Alternatively solenoid (26) can be employed to operate only to push diverter (25) against the operation of a spring (not shown) which maintains diverter (25) in the farthest position to the right, closing the entrance to flue passage (8). Such an arrangement would function as a safety factor in maintaining the unobstructed flue passage (7) open at all times except when the use of heat exchanger (10) is demanded by room thermostat (19). The third control exerted by control switch (18) is to actuate solenoid valve (27) by opening the line in which the valve is located to permit water from the main water line to feed into misting jets (28) which serve to extinguish the burning material in combustion zone (1) if the temperature sensing means (20) indicates an undesirably high temperature. An added safety feature in the heat exchanger (10) is relief valve (21) which is joined to a pipeline directed to a drain in the basement or elsewhere in the building wherein the fireplace is located. This relief valve would be designed to operate automatically to release any build-up of pressure or temperature should that occur in the hotter portions of the interior conduits of heat exchanger (10).

All of the control and sensing devices employed in this invention are conventional appliances and auxiliary devices which may be obtained from any well equipped plumbing supply organization. The entire control system embodied by control switch (18) solenoids (26) and (27), circulator (14) and the necessary loads and conduits for connecting those devices are preferably enclosed in a suitable panel box on the back or the side of a fireplace such that all items would be available for servicing and adjustment, but would be completely out of sight from the front of the fireplace.

In the normal operation of the system of this invention when heat is not needed elsewhere in the house a fire is burning in combustion zone (1) with damper (5) open and diverter (25) in the position which closes second flue passage (8) and thereby directs all of the hot flue gases through first flue passage (7). When the temperature in the area where room thermostat (19) is located becomes low enough the thermostat signals for heat through control switch (18) which, in turn, activates solenoid (26) to move diverter (25) so as to open second flue passage (8) and permit hot flue gases to pass through heat exchanger (10). Control switch (18) also at this time turns circulator (14) on so as to circulate water through heat exchanger (10) and to heating element (13). When room thermostat (19) indicates that the desired room temperature is reached it signals control switch (18) which closes diverter (25) by activating solenoid (26), but does not shut down circulator (14) until the water temperature reaches a lower limit. If the water temperature in the heat exchanger should rise too high it will activate sensing means (20) which, through control switch (18), will override any demand for heat from thermostat (19) and will cause solenoid (26) to move diverter (25) to close the second flue passage (8) to the hot flue gases and thereby permit the water temperature in heat exchanger to drop from the unsafe high limit to an operating temperature. If this safety feature fails to operate and the temperature in sensing means (20) continues to rise to a second high limit, it signals control switch (18) to activate solenoid (27) which opens valves in the water line to misting jets (28) which extinguish the fire in combustion zone (1).

Figure 2:
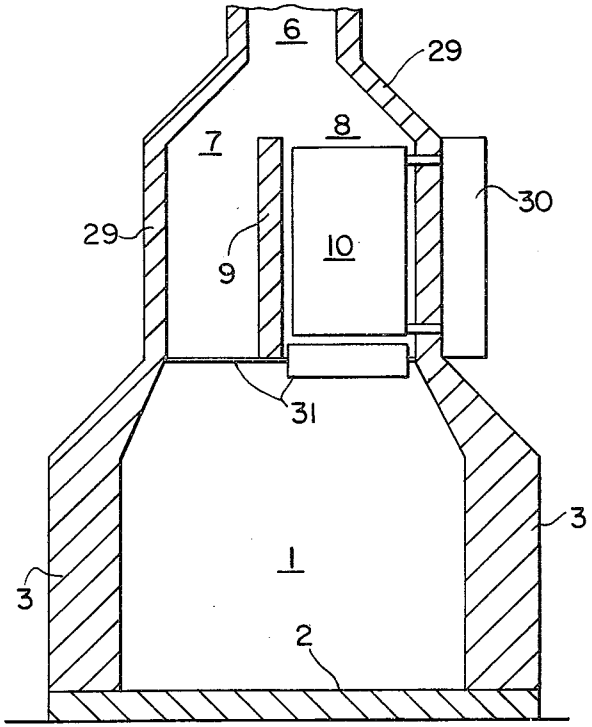
FIG. 2 is a cross-sectional front elevation view of this invention wherein the flue passages are side-by-side.

In FIG. 2 there is shown an alternate embodiment of this invention wherein the flue passages (7) and (8) are in a side-by-side relationship, rather than the back-to-back relation ship shown in FIG. 1. The side-by-side relationship of FIG. 2 permits use of a suitable panel box (30) to contain all of the necessary controls and switches described above for FIG. 1. Thus, where a fireplace was located on an outside wall of a residence, it would be more convenient to employ the embodiment of FIG. 2 so as to have all of the controls, piping, and wiring available in the same room as the fireplace. Where the fireplace is not on an outside wall, either of the arrangements would be suitable. The only modification which this embodiment requires is in the design of diverter (31). In this embodiment the diverter may be of a "butterfly" design comprising two plates welded to an axially rotatable rod, such plate being oriented 90° from the other so that when the rod is rotated to close flue passage (7) as shown in FIG. 2, it will simultaneously open flue passage 8.

Figure 3:
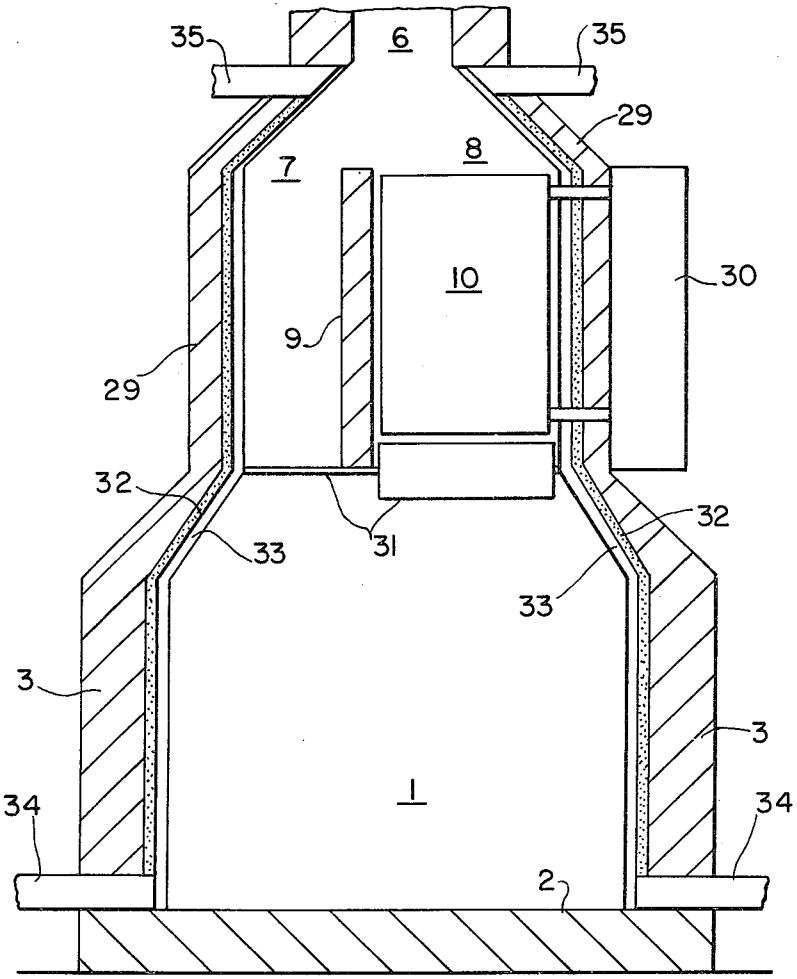
FIG. 3 is a cross-sectional front elevation view of an embodiment of this invention including an air jacket to supplement a hot air heating system.

In FIG. 3 there is shown a means for supplementing the heating obtained from the systems of FIGS. 1 and 2. In this arrangement the principal features of the fireplace, flues, heat exchanger, etc. are identical to those in FIG. 2 except for the jackets which line the outer walls of the fireplace and flues. As illustrated in FIG. 3 there is a layer of insulation (32) on the inside surface of the fireplace combustion zone (1) and the two flues (7) and (8) extending from the hearth (2) to the smokepipe (6). Inside of and contiguous to layer (32) is an air jacket (33) having inlets (34) for cold air and outlets (35) for hot air. This jacket (33) serves as a supplemental heat absorbing means to absorb heat from the fire in combustion zone (1) and the hot flue gases in flues (7) and (8) and to transmit that heat to air circulating through jacket (33). Inlets (34) and outlets (35) can be connected to the existing hot air heating system in a residence or passed through appropriate conduits to any location where it is desirable to discharge the heat, e.g. to a room that is not adequately heated by other means. In preferred embodiments, the air passing through jacket (33) is moved by a suitable fan (not shown in FIG. 3). The combination of jacket (33) and insulation layer (32) may be constructed as a unit and placed in an existing fireplace and flue as prefabricated sections. If the insulation is of adequate thickness and quality the sections can be installed with "zero clearance", i.e. without leaving space for expansion due to heating and cooling, thus facilitating the installation. The combination of jacket (33) and insulation layer (32) is preferably installed with zero clearance at the time the fireplace is originally built.

There are many alternative means for accomplishing the sensing and control operations set forth in the above description. It is not intended that any one means be employed to the exclusion of others since the foregoing description is merely illustrating the basic features of the invention. Furthermore, the heating system of this invention is not intended to be resticted solely to fireplaces. There are hot flue gases passing upwardly through flues in every residence, office building, and factory that is heated by coal, oil, gas, or the like. The system of this invention can be employed to conserve the heat in any flue of such buildings. Moreover, the present invention can be easily adapted to supplement heating systems employing solar heat, heat pumps, or any other type of heating wherein a circulating fluid is heated in one location and pumped to another location to discharge its heat.

Although the invention has been described in considerable detail with reference to certain preferred embodiments thereof, it will be understood that variations and modifications can be effected within the spirit and scope of the invention as described hereinabove and as defined in the appended claims.

What is claimed is:

1. Automatically controlled residential heating system based on the heat from a fireplace comprising a fireplace, hearth, combustion zone, flue, and damper for opening and closing the passageway from the combustion zone to the flue, said flue being divided into two full-sized parallel independent flue passages, one of which is an unobstructed normal flue passage and the other of which is filled with a heat exchanger adapted to absorb the heat from hot gases passing through the flue into a fluid in said heat exchanger, a movable diverter adapted to direct the hot gases into either parallel flue or into both in any desired proportion, a means for circulating a heat absorbing fluid through said heat exchanger and releasing the absorbed heat through space heaters at other locations, means for sensing the heat in the space to be heated by space heaters, means for sensing the temperature of the fluid in said heat exchanger, means for automatically positioning said diverter to by-pass none, all, or any part of said hot gases from said heat exchanger in response to the temperatures of the two said sensing means, means to relieve any undue build-up of heat in said heat exchanger, and means to automatically extinguish the burning material in said combustion zone if the means for sensing the temperature in said heat exchange fluid indicates an undesirably high temperature.

2. An automatically controlled heating system to recover and use the heat in hot gases passing through a flue from the furnace to the chimney of a building comprising two full-sized parallel independent flue passages both of which are connected at their lower extermities to the outlet of the combustion zone of a furnace and both of which are connected at their upper extremities to the chimney conducting the flue gases out of the building to the atmosphere, one of said flue passages being an unobstructed normal flue passage and the other of which being filled with a heat exchanger adapted to absorb the heat from the hot gases passing through the flue into a fluid in said heat exchanger, a movable diverter adapted to direct the hot gases into either parallel flue or into both in any desired proportion, a means for circulating a heat absorbing fluid through said heat exchanger and releasing the absorbed heat through space heaters at other locations, means for sensing the heat in the space to be heated by space heaters, means for sensing the temperature of the fluid in said heat exchanger, means for automatically positioning said diverter to by-pass none, all, or any part of said hot gases from said heat exchanger in response to the temperatures of the two said sensing means, means to relieve any undue build-up of heat in said heat exchanger.

3. The heating system of claim 1 wherein said fluid in said heat exchanger is water.

* * * * *